US006091311A

United States Patent [19]

Waters

[11] Patent Number: 6,091,311

[45] Date of Patent: Jul. 18, 2000

[54] SELECTABLE PATH STRIPLINE/SLOTLINE DIGITAL PHASE SHIFTER

[75] Inventor: William M. Waters, Millerville, Md.

[73] Assignee: The United States of America as represented by the Secretary of the Navy, Washington, D.C.

[21] Appl. No.: 08/915,715

[22] Filed: Aug. 21, 1997

[51] Int. Cl.[7] ..... H01P 1/185

[52] U.S. Cl. ..... 333/161; 333/164

[58] Field of Search ..... 333/161, 164, 333/156

[56] References Cited

U.S. PATENT DOCUMENTS

| | | | |
|---|---|---|---|
| 5,116,807 | 5/1992 | Romanofsky et al. | 333/161 X |
| 5,400,040 | 3/1995 | Lane et al. | 343/700 MS |
| 5,572,222 | 11/1996 | Mailandt | 343/700 MS |

FOREIGN PATENT DOCUMENTS

| | | | |
|---|---|---|---|
| 3295301 | 12/1991 | Japan | 333/161 |
| 4063002 | 2/1992 | Japan | 333/161 |
| 1418829 | 8/1988 | Russian Federation | 333/164 |

OTHER PUBLICATIONS

Pozar, "Flat Lens Antenna Concept Using Aperture coupled Microstrip Patches, Elec. Ltrs", vol. 32, No.23, pp. 2109–2111, Nov. 1996.

Pozar, "Microstrip Antennas", Proc. IEEE, vol. 80, No. 1, pp. 79–91, Jan. 1992.

Sullivan et al., Analysis of an Aperture Coupled Antenna, IEE Trans. Ant. and Prop., vol. AP–34, No. 8, pp. 977–984,b Aug. 1986.

Simons, Novel Coplanar Stripline to Slotline Transition on High Resistivity Silicon, Elec. Ltrs, vol. 30, No. 8, pp. 6J4–655, Apr. 1994.

Klorr, Slotline Transitions, IEEE Trans. Micro. Theory & Tech., pp. 548–554, May 1974.

Bennalla et al., "Multiport Wetwork for Modelling the Mutual Coupling Effects in Microstrip Patch Antennas and Arrays", IEEE Trans on Ant Prop; vol. 37; No.2; Feb. 1989

Huang, "A KA–Band Circularly Polarized High–Gain Microstrip Array Antenna",IEEE Trans., Ant. & Prop., vol. 43, No. 1, pp. 113–116, Jan. 1995.

Herscovici et al., Analysis and Design or Multilayer Printed Antennas: A Modular Approach, IEEE Trans. Ant. Prop., vol. 41, No. 10, pp. 1371–1378, Oct. 1993.

Pozar, A Reciprocity Method of Analysis for Printed Slot and Slot–Coupled Microstrip Antennas, IEEE Trans,. Ant. Prop., vol. ap–34 No. 12, pp. 1439–1446, Dec. 1986.

Gupta et al., Microstrip Lines and Slotlines, 2d ED, Artech Husse, Boston, Ch. 5, pp. 269–340,1996.

"Antenna Engineering Handbook ", McGraw–Hill New York, R. C. Johnson (ed.), Chs. 16 &20, 1984, Skolnick, Radar Handbook, McGraw–Hill, New York, pp. 10–10–1029, 1970.

*Primary Examiner*—Benny T. Lee

*Attorney, Agent, or Firm*—Barry A. Edelberg; Charles J. Stockstill

[57] ABSTRACT

The stripline-slotline digital phase shifter is located between a ground plane associated with a patch antenna and another ground plane associated with the other patch antenna, or other output circuits. It is comprised of a section of stripline adjacent to a slot in ground plane associated with the receiving patch antenna which transitions an input electromagnetic signal to a plurality of oval slotlines, called bit circuits, of varying lengths which form a delay circuit by shifting the phase of the input electromagnetic signal. The varying lengths of slotline are switched into and out of the circuit to provide a predetermined amount of delay and the phase adjusted electromagnetic signal is transitioned to portion of stripline adjacent to a slot associated with the transmission patch antenna or other output circuits.

10 Claims, 2 Drawing Sheets

STRIPLINE-TO-SLOTLINE DIGITAL PHASE SHIFTER

STRIPLINE-TO-SLOTLINE DIGITAL PHASE SHIFTER

SELECTABLE PATH STRIPLINE/SLOTLINE DIGITAL PHASE SHIFTER

BACKGROUND OF THE INVENTION

1. Field of the Invention

This invention pertains generally to phase shifters associated with array antennas and more specifically to a device utilizing stripline/slotline transitions to facilitate digital shift of the electromagnetic signal phase in an antenna array.

2. Description of the Related Art

Microstrip patch antennas for flat phased antenna arrays, date back to the 1950's and have been reviewed by D. M. Pozar. See, D. M. Pozar, *Microstrip Antennas,* Proc. IEEE, Vol. 80, No.1, pp. 79–91, Jan. 1992. Their development has been driven by systems requirements for antennas with low-profile, low weight, low cost, easy integrability into arrays with polarization diversity or with microwave integrated circuits. This antenna is basically comprised of a feed layer, selected intermediate layers, and a radiating antenna having one side exposed to free space, in some cases through a radome layer. In order to scan the antenna beam, each antenna element must be equipped with a phase shifter; however, low-cost, small-size phase shifters are unavailable at the present time.

Circuits forming the intermediate layers of a patch antenna are comprised of a dielectric substrate covered by patterned metallic, electrically-conductive sheets used to convey electromagnetic power among electronic components such as phase shifters. One form of circuit is a transmission line known as microstrip, a planar structure consisting of two sheets of electrically conductive material, the two sheets being spaced apart by a single dielectric substrate. One of the sheets is etched to provide strip conductors which in cooperation with the other sheet (ground plane) supports a transverse electromagnetic (TEM) wave. Two other forms of planar transmission lines known as stripline and slotline are used in this invention.

This invention utilizes a type of phase shifting circuit board that combines stripline with slot line to form a small, efficient, low-cost phase shifter that may be incorporated with an aperture coupled patch antenna. See, D. M. Pozar, *Flat Lens Antenna Concept Using Aperture Coupled Microstrip Patches,* Elect. Ltrs., Vol. 32, No. 23, pp. 2109–2111, Nov. 1996.

SUMMARY OF THE INVENTION

The object of this invention is to provide an efficient, low-cost, small-size phase shifter to be used with patch, or similar antennas.

This and other objectives are accomplished by utilizing a stripline/slotline phase shifter located between a conducting ground plane associated with combining circuits and a plane associated with antenna elements of a phased array. The phase shifter is comprised of a section of stripline coupled to a resonant slot in a ground plane associated with the patch antenna. These circuits convey an input electromagnetic signal to a plurality of oval configuration slotlines, called bit circuits. The varying lengths of slotline in the bit circuits are switched into and out of the circuit to provide predetermined amounts of delay; in a lens phased array, the phase-adjusted electromagnetic signal is coupled to stripline adjacent to a resonant slot associated with the transmission patch antenna. All circuits are reciprocal so that input and output directions may be interchanged.

BRIEF DESCRIPTION OF THE DRAWINGS

In the following specification and figures, like elements are designated by the same reference label and may not be described for all figures.

DESCRIPTION OF THE PREFERRED EMBODIMENTS

Figure 1A:
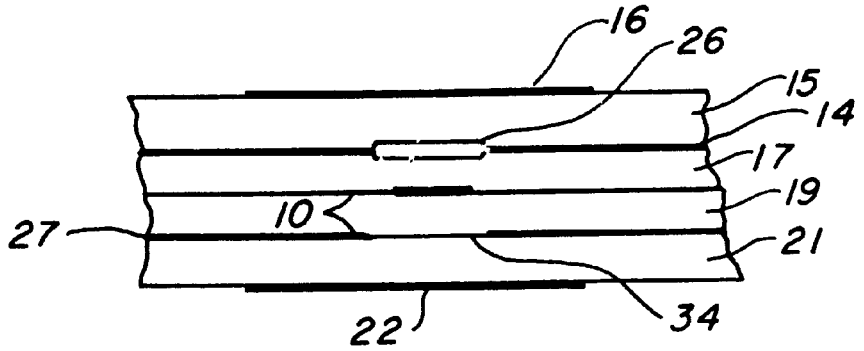
FIG. 1*a* shows a side view of a basic lens antenna with a stripline-slotline phase shifter with four bit circuits.
Figure 1B:
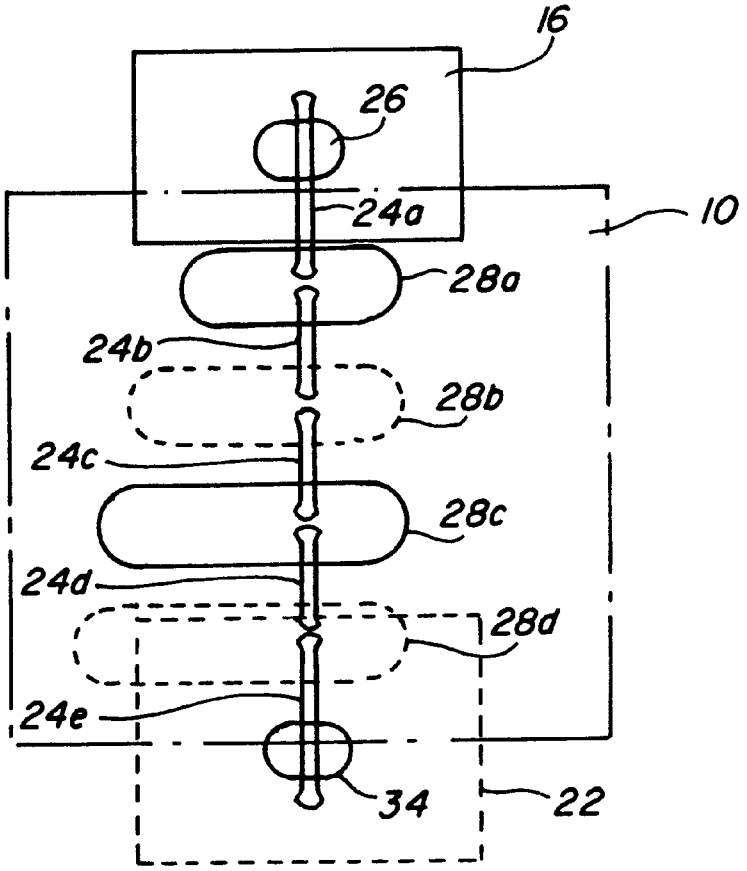
FIG. 1*b* shows a perspective view of a basic lens antenna with stripline-slotline phase shifter with four bit circuits.

In a first embodiment of a stripline-slotline phase shifter 10, as shown in FIGS. 1*a* and 1*b* may be located between a ground plane 14 associated with a transmitting patch antenna 16 and a ground plane 27 associated with an output patch antenna 22. Separating patch antennas 16 and 22 are dielectric substrates 15, 17, 19, and 21, as shown in FIG. 1*a*, having distinct dielectric constants to control system bandwidth and to reduce the physical lengths of the phase shifters circuit, such as shown in Table 1.

TABLE 1

| SUBSTRATE REF NO. | DIELECTRIC CONSTANT |
|---|---|
| 15 | 2.2 |
| 17 | 20.0 |
| 19 | 20.0 |
| 21 | 2.2 |

A stripline-slotline digital phase shifter 10 is comprised of sections of stripline 24*a*, 24*b*, 24*c*, 24*d*, and 24*e* mounted between substrates 17 and 19 and coupling to resonant slots 26 and 34 in the ground planes 14 and 27, as shown in FIG. 1*a*. (FIG. 1*a* is a side view of FIG. 1*b* to show the layering of the components comprising the first embodiment.) The slot 26 is between substrates 17 and 15. The conducting patch antenna 16 is printed on substrate 15; patch antenna 22 is printed on substrate 21. An electromagnetic signal propagating top to bottom in FIG. 1*a* couples to the patch antenna 16, through the resonant slot 26 and propagates downward (FIG. 1*b*) along stripline 24*a* to a plurality of oval slotlines, called bit circuits, 28*a*, 28*b*, 28*c*, and 28*d* of varying lengths forming a delay circuit. The stripline segments 24*a*, 24*b*, 24*c*, 24*d*, and 24*e* are printed between substrates 17–19 and bit circuits 28*a*–*d* are cut in ground planes 14 and 27; bit circuits 28*a* and 28*c* are cut in ground plane 27, and bit circuits 28*b* and 28*d* are cut in ground plane 14.

Varying lengths of slotline forming bit circuits 28*a*–28*d* are switched into and out of the circuit to provide a predetermined amount of delay and the phase adjusted electromagnetic signal. The design of the stripline/slotline transitions of this invention is well known to those skilled in the art and may be found in Gupta et al., *Microstrip and Slotlines,* 2d Ed., Artech House, Boston, Ch. 15, pp. 269–340, 1996.

Figure 2A:
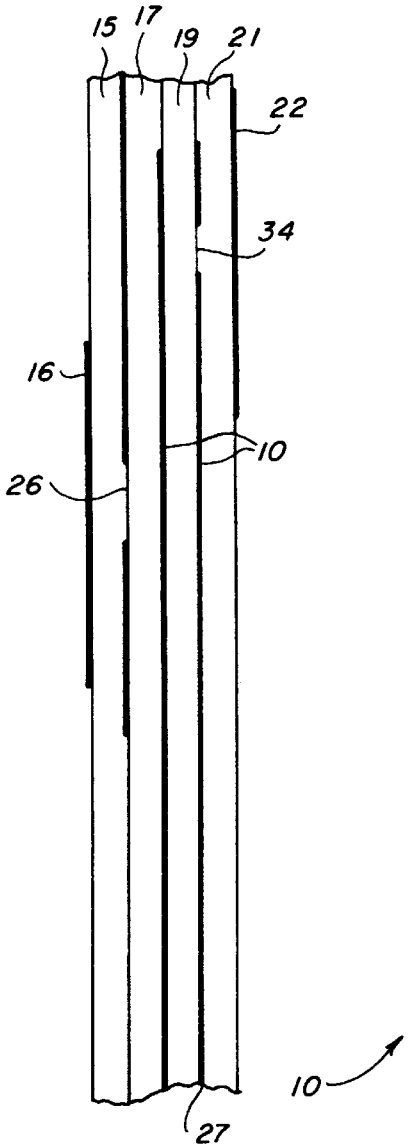
FIG. 2*a* shows a side view of a patch antenna with a stripline-slotline phase shifter with five bit circuits.
Figure 2B:
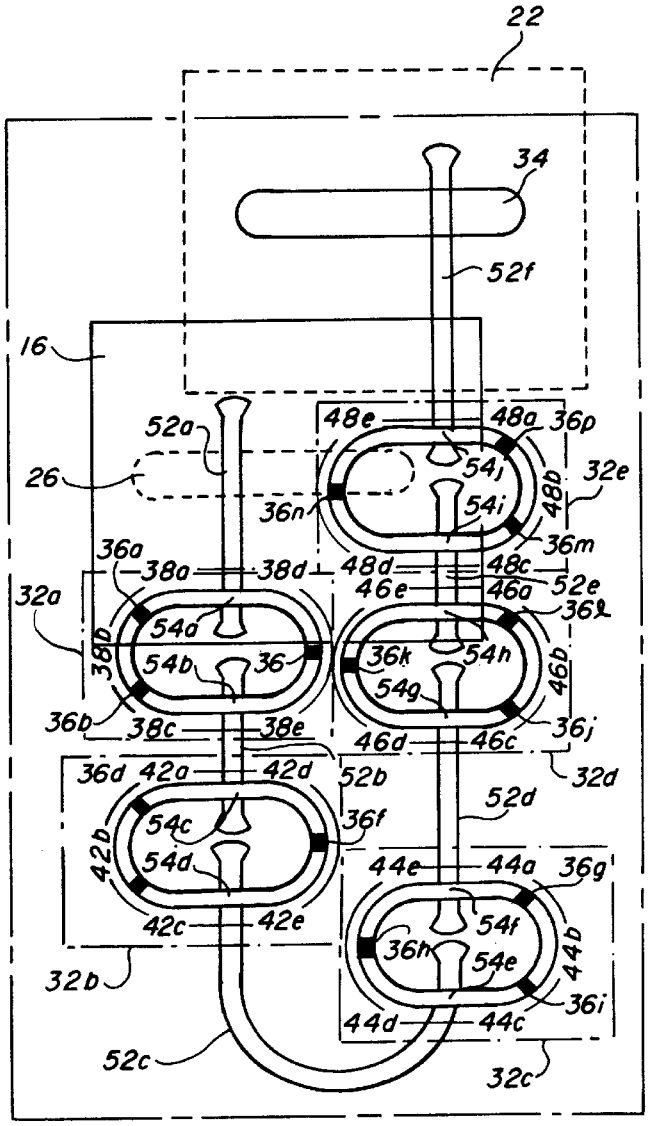
FIG. 2*b* shows a perspective view of a patch antenna with a stripline-slotline phase shifter with five bit circuits.

In another preferred embodiment 20, utilizing the same reference numbers for like components, as those shown in FIGS. 2*a* and 2*b* (FIG. 2*a* being a side view of FIG. 2*b* to show the layering of the components comprising the embodiment), bit circuits, are designed as shown in FIGS. 2*a* and 2*b*. The method of switching the various lengths of slotline of the oval slotlines, 32*a*, 32*b*, 32*c*, 32*d* and 32*e* of varying lengths ($\lambda/32$, $\lambda/16$, $\lambda/8$, $\lambda/4$, and $\lambda/2$) forming the delay circuit utilizes a plurality of switches 36*a*, 36*b*, 36*c*, 36*d*, 36*e*, 36*f*, 36*g*, 36*h*, 36*i*, 36*j*, 36*k*, 36*l*, 36*m*, 36*n*, 36*o* and 36*p*.

The switches 36$a$–36$p$ determine the path of the electromagnetic signal and thereby the amount of line delay inserted into the path of the electromagnetic signal. These switches 36$a$, 36$b$, 36$c$, 36$d$, 36$e$, 36$f$, 36$g$, 36$h$, 36$i$, 36$j$, 36$k$, 36$l$, 36$m$, 36$n$, 36$o$, and 36$p$ are preferably diodes of a type well known to those skilled in the art. The theory of operation of each bit circuit element 32$a$–32$e$ is similar, therefore for simplicity only a functional description of the operation of bit circuit element 32$a$ will be discussed. Associated with each bit circuit element 32$a$–32$e$, there are three switches 36$a$–36$c$. Two switches, 36$a$ and 36$b$, provide short circuits in the longer slot line (38$a$ ($\lambda/4$)+38$b$ ($\lambda/32$)+38$c$ ($\lambda/4$)=$17\lambda/32$) and switch 36$c$ provides a short circuit in the shorter line (38$d$ ($\lambda/4$)+38$e$ ($\lambda/4$)=$\lambda/2$). The electromagnetic signal will couple from the stripline 52$a$ to the longer slotline (38$a$+38$b$+38$c$) when the switches 36$a$ and 36$b$ are open and the single switch 36$c$ in the shorter slotline (38$d$+38$e$) is closed; in this state the bit circuit 32$a$ delays the signal by $\lambda/2+\lambda/32$. The unused shorter slotline (38$d$+38$e$) does not cause an impedance mismatch since it forms a quarter-wave shorted stub (high impedance) across each of the two stripline-slotline junctions 54$a$ and 54$b$. When the two switches 36$a$ and 36$b$ are closed and the single switch 36$c$ is open, the electromagnetic signal couples to the shorter slotline (38$d$+38$e$) and is delayed by $\lambda/2$; again each stripline-slotline junctions 54$a$ and 54$b$ are loaded by a shorted $\lambda/4$ stub in the longer slotline (38$a$+38$b$+38$c$). The same theory applies to switching in and out the other sections of slotline 42$a$–42$e$ in the remaining bit circuits 32$b$–32$e$.

Preferably, the switches 36$a$–36$p$ may be controlled in three ways. Since optical fibers are transparent to microwave and millimeter wave energy, the switches 36$a$–36$p$ may be photodiodes controlled by dedicated optical fiber (not shown). Optical fibers are very small (a few hundred microns in diameter) and have very low losses ( a few dB/KM). Or photodiode switches may be controlled by infrared (IR) beams. Both of these controls are well known to those skilled in the art. A third alternative would involve imbedding a thin stripline control layer between halves of a conducting "plane".

The lengths of the slot line segments are as shown in FIG. 2$b$ and Table 2.

TABLE 2

| BIT CIRCUIT SEGMENT | LENGTH |
|---|---|
| 38a | λ/4 |
| 38b | λ/32 |
| 38c | λ/4 |
| 38d | λ/4 |
| 38e | λ/4 |
| 42a | λ/4 |
| 42b | λ/16 |
| 42c | λ/4 |
| 42d | λ/4 |
| 42e | λ/4 |
| 44a | λ/4 |
| 44b | λ/8 |
| 44c | λ/4 |
| 44d | λ/4 |
| 44e | λ/4 |
| 46a | λ/4 |
| 46b | λ/4 |
| 46c | λ/4 |
| 46d | λ/4 |
| 46e | λ/4 |
| 48a | λ/4 |
| 48b | λ/2 |
| 48c | λ/4 |
| 48d | λ/4 |
| 48e | λ/4 |

When all bit circuits 32$a$–$e$ are switched to the short lines (typified by 38$d$+38$e$) this introduces minimum delay equal to $5\lambda/2$ plus a constant delay due to stripline segments 52$a$, 52$b$, 52$c$, 52$d$, 52$e$, and 52$f$. When all are connected to the longer lines (typified by 38$a$+38$b$+38$c$), the bit circuits 32$a$–32$e$ introduce the maximum delay equal to the minimum delay plus $31\lambda/32$. The bit circuits 32$a$–32$e$ are controlled by a 5-bit digital word (e.g., binary 1 switches in the longer delay); hence, the total delay may be set to any value between the minimum delay (00000) and the minimum delay plus $31\lambda/32$ (11111). Bit circuit performance depends upon preserving an impedance in both states of each bit circuit. The impedance match is assured since in both states the unused slotline loads the junctions (typified by 54$a$ and 54$b$) with quarter-wave stub (high impedance), thus providing a good match over a wide band (e.g., 10%).

This invention provides an efficient, low-cost, small-size phase shifter to be used, for example, in patch antenna arrays. However, the invention is applicable to any type of array antennas in the microwave and millimeter wavelengths.

Although the invention has been described in relation to the exemplary embodiment thereof, it will be understood by those skilled in the art that still other variations and modifications can be affected in the preferred embodiment without detracting from the scope and spirit of the invention as stated in the claims.

What is claimed is:

1. A phase shifter comprised of:

a first open-ended stripline element for receiving an input electromagnetic signal of a predetermined wavelength and coupling said input electromagnetic signal to a first slotline bit element of a plurality of slotline bit elements;

said input electromagnetic signal being coupled to the plurality of slotline bit elements by a series of stripline-slotline transitions to produce an output electromagnetic signal having a predetermined phase shift;

a plurality of digitally controlled electronic switches to shift the phase of the electromagnetic signal by selecting a respective length through each slotline bit element of the plurality of slotline bit elements, each slotline bit element having a selectable short path length or a selectable long path length to selectively vary a total path through which the input electromagnetic signal propagates; and a second open-ended stripline element coupled to a last slotline bit element, of the plurality of slotline bit elements, coupling the output electromagnetic signal to an output device.

2. A phase shifter comprised of:

a first open-ended stripline element for receiving an input electromagnetic signal of a predetermined wavelength and coupling said input electromagnetic signal to a first slotline bit element of a plurality of slotline bit elements;

said input electromagnetic signal being further coupled to the plurality of slotline bit elements by a series of stripline-slotline transitions to produce an output electromagnetic signal having a predetermined phase shift;

said phase shift in the input electromagnetic signal being accomplished by selecting a respective length of slotline associated with corresponding ones of the plurality of slotline bit elements, each path length of the respective slotline bit element being either a selectable short path length or a selectable long path length to selectively vary a total path through which the input electromagnetic signal propagates; and a second open-ended stripline element coupled to a last slotline bit element, of the plurality of slotline bit elements, coupling the output electromagnetic signal to an output device.

3. A phase shifter, as in claim 2, wherein varying of the total path length of the input electromagnetic signal is through the activation of a plurality of selectively controllable switches so as to direct the input electromagnetic signal through the short or long path length of respective ones of the plurality of slotline elements to obtain a desired phase shift through variance of the total path length.

4. A phase shifter, as in claim 2, wherein the switches are diodes.

5. A phase shifter, as in claim 2, wherein the switches are digitally controlled optically switches.

6. A phase shifter, as in claim 2, wherein the switches are digitally controlled electronically.

7. A phase shifter comprised of:

a first open-ended stripline element for receiving an input electromagnetic signal of a predetermined wavelength;

said input electromagnetic signal being further coupled to a plurality of slotline bit elements through a series of stripline-slotline transitions to produce an output electromagnetic signal having a predetermined phase shift;

the phase shift in the input electromagnetic signal being accomplished by selecting a respective length through each slotline element of the plurality of slotline bit elements, each path length of the respective slotline element being either a selectable short path length or a selectable long path length to provide a total electrical length between the first open-ended strip-line element and a second open-ended stripline element of such length required to provide a phase shifted output signal; and the second open-ended stripline element coupling the output phase shifted electromagnetic signal to an output device.

8. A method for shifting the phase shifter of, a stripline-slotline apparatus comprising the steps of:

receiving an input electromagnetic signal of a predetermined wavelength in a first open-ended stripline element;

coupling said input electromagnetic signal to a first slotline bit element of a plurality of slotline bit elements;

shifting the phase in the input electromagnetic signal selecting a respective length through each slot line element of the plurality of slotline bit elements, each path length of the respective slotline element being either a selectable short path length or a selectable long path length to selectively vary a total path through which the input electromagnetic signal propagates; and coupling the phase shifted electromagnetic signal through a second open-ended stripline element coupled to a last slotline bit element, of the plurality of slotline bit elements, to an output device.

9. A phase shifter comprised of:

a first open-ended stripline element for receiving an input electromagnetic signal of a predetermined wavelength and coupling said input electromagnetic signal to a first slotline bit element of a plurality of slotline bit elements;

said input electromagnetic signal being further coupled to the plurality of slotline bit elements by a series of stripline-slotline transitions to produce an output electromagnetic signal having a predetermined phase shift;

a plurality of selectively controllable switches to shift the phase of the input electromagnetic signal by selecting a respective length of slotline associated with corresponding ones of the plurality of slotline bit elements, each path length of the respective slotline element being either a selectable short path length or a selectable long path length to selectively vary a total path length through which the input electromagnetic signal propagates; and a second open-ended stripline element coupled to a last slotline bit element, of the plurality of slotline bit elements, coupling the output electromagnetic signal to an output device.

10. A phase shifter comprised of:

a first open-ended stripline element for receiving an input electromagnetic signal of a predetermined wavelength and coupling said input electromagnetic signal to a first slotline bit element of a plurality of slotline bit elements;

said input electromagnetic signal being further coupled to the plurality of slotline bit elements by a series of stripline-slotline transitions to produce an output electromagnetic signal having a predetermined phase shift;

a plurality of digitally controlled optical switches to shift the phase of the electromagnetic signal by selecting a respective length of slotline through each slotline element of the plurality of slotline bit elements, each path length of the respective slotline element being either a selectable short path length or a selectable long path length to selectively vary a total path through which the input electromagnetic signal propagates; and a second open-ended stripline element coupled to a last slotline bit element, of the plurality of slotline bit elements, coupling the output electromagnetic signal to an output device.

* * * * *